US007413300B2

(12) United States Patent
Von Essen et al.

(10) Patent No.: US 7,413,300 B2
(45) Date of Patent: Aug. 19, 2008

(54) RECIRCULATION ASSEMBLY

(75) Inventors: Kevin Von Essen, San Jose, CA (US); John A. Higginson, Santa Clara, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 317 days.

(21) Appl. No.: 11/116,696

(22) Filed: Apr. 27, 2005

(65) Prior Publication Data

US 2005/0243146 A1 Nov. 3, 2005

Related U.S. Application Data

(60) Provisional application No. 60/567,070, filed on Apr. 30, 2004, provisional application No. 60/567,035, filed on Apr. 30, 2004.

(51) Int. Cl.
*B41J 2/18* (2006.01)

(52) U.S. Cl. ..... 347/89

(58) Field of Classification Search ..... 347/85, 347/89

See application file for complete search history.

(56) References Cited

U.S. PATENT DOCUMENTS

| | | | | |
|---|---|---|---|---|
| 4,433,341 | A * | 2/1984 | Thomas | 347/6 |
| 4,527,175 | A * | 7/1985 | Kojima et al. | 347/85 |
| 4,680,696 | A * | 7/1987 | Ebinuma et al. | 347/85 |
| 4,929,963 | A * | 5/1990 | Balazar | 347/89 |
| 4,937,598 | A | 6/1990 | Hine | |
| 5,461,405 | A | 10/1995 | Lehmann et al. | |
| 5,646,658 | A | 7/1997 | Thiel et al. | |
| 5,751,300 | A * | 5/1998 | Cowger et al. | 347/6 |
| 5,782,184 | A | 7/1998 | Albertalli et al. | |
| 5,936,650 | A * | 8/1999 | Ouchida et al. | 347/89 |
| 6,152,559 | A * | 11/2000 | Kojima | 347/89 |
| 6,428,141 | B1 | 8/2002 | McElfresh et al. | |
| 6,467,874 | B1 | 10/2002 | Williams et al. | |
| 6,655,786 | B1 | 12/2003 | Foote et al. | |
| 6,672,706 | B2 | 1/2004 | Silverbrook | |
| 6,672,707 | B2 | 1/2004 | Silverbrook | |
| 6,715,863 | B2 * | 4/2004 | Shimizu | 347/85 |
| 6,752,493 | B2 | 6/2004 | Dowell et al. | |
| 6,796,630 | B2 | 9/2004 | Ison et al. | |

(Continued)

FOREIGN PATENT DOCUMENTS

| | | |
|---|---|---|
| EP | 0666177 | 8/1995 |
| EP | 1186416 | 3/2002 |

*Primary Examiner*—Anh T. N. Vo
(74) *Attorney, Agent, or Firm*—Fish & Richardson P.C.

(57) ABSTRACT

An ink recirculation assembly includes a main ink inlet configured to receive ink from an ink source, a main ink outlet configured to direct ink toward an ink source, and a channel extending from the main ink inlet to the main ink outlet. The channel includes an inlet portion and an outlet portion. A pressure differential is formed across the inlet and outlet portions, for example, by a constrictor separating said portions. The inlet portion is configured to move ink from the main ink inlet to openings formed in the inlet portion, said openings configured to direct ink toward ink inlet channels for each of multiple printhead modules. An outlet portion is configured to move ink away from openings formed in the outlet portion toward the main ink outlet, said openings configured to receive ink from ink outlet channels for each of the multiple printhead modules.

14 Claims, 12 Drawing Sheets

U.S. PATENT DOCUMENTS

| | | | |
|---|---|---|---|
| 6,869,167 | B2 | 3/2005 | Silverbrook |
| 2002/0024554 | A1 | 2/2002 | Tominaga |
| 2002/0180827 | A1 | 12/2002 | Hirota |
| 2002/0180835 | A1 | 12/2002 | Boyd et al. |
| 2003/0227516 | A1 | 12/2003 | Yamaguchi et al. |
| 2004/0021735 | A1 | 2/2004 | Horii et al. |
| 2005/0243127 | A1 | 11/2005 | Higginson et al. |
| 2006/0250493 | A1 | 11/2006 | Silverbrook et al. |

* cited by examiner

RECIRCULATION ASSEMBLY

CROSS REFERENCE TO RELATED APPLICATIONS

This application claims priority to pending U.S. Provisional Application Ser. No. 60/567,035, entitled "Recirculation Assembly", filed on Apr. 30, 2004, and pending U.S. Provisional Application Ser. No. 60/567,070, entitled "Mounting Assembly", filed on Apr. 30, 2004, the entire contents of which are hereby incorporated by reference.

BACKGROUND

The following description relates to a recirculation assembly.

An ink jet printer typically includes an ink path from an ink supply to an ink nozzle assembly that includes nozzle openings from which ink drops are ejected. Ink drop ejection can be controlled by pressurizing ink in the ink path with an actuator, which may be, for example, a piezoelectric deflector, a thermal bubble jet generator, or an electrostatically deflected element. A typical printhead has a line of nozzle openings with a corresponding array of ink paths and associated actuators, and drop ejection from each nozzle opening can be independently controlled. In a so-called "drop-on-demand" printhead, each actuator is fired to selectively eject a drop at a specific pixel location of an image, as the printhead and a printing media are moved relative to one another. In high performance printheads, the nozzle openings typically have a diameter of 50 microns or less (e.g., 25 microns), are separated at a pitch of 100-300 nozzles per inch and provide drop sizes of approximately 1 to 70 picoliters (pl) or less. Drop ejection frequency is typically 10 kHz or more.

A printhead can include a semiconductor printhead body and a piezoelectric actuator, for example, the printhead described in Hoisington et al., U.S. Pat. No. 5,265,315. The printhead body can be made of silicon, which is etched to define ink chambers. Nozzle openings can be defined by a separate nozzle plate that is attached to the silicon body. The piezoelectric actuator can have a layer of piezoelectric material that changes geometry, or bends, in response to an applied voltage. The bending of the piezoelectric layer pressurizes ink in a pumping chamber located along the ink path.

Printing accuracy can be influenced by a number of factors, including the uniformity in size and velocity of ink drops ejected by the nozzles in the printhead and among the multiple printheads in a printer. The drop size and drop velocity uniformity are in turn influenced by factors, such as the dimensional uniformity of the ink paths, acoustic interference effects, contamination in the ink flow paths, and the uniformity of the pressure pulse generated by the actuators. Contamination or debris in the ink flow can be reduced with the use of one or more filters in the ink flow path.

In some applications, the ink is recirculated from the ink source to the printhead and back to the ink source, for example, to prevent coagulation of the ink and/or to maintain the ink at a certain temperature above the ambient temperature, for example, by using a heated ink source.

SUMMARY

An ink recirculation assembly is described. In general, in one aspect, the invention features an ink recirculation assembly including a main ink inlet configured to receive ink from an ink source and a main ink outlet configured to direct ink toward an ink source. The recirculation assembly further includes a channel extending from the main ink inlet to the main ink outlet, the channel including an inlet portion and an outlet portion separated by a constrictor to form a pressure differential between the inlet and outlet portions. A plurality of first openings are formed in the inlet portion of the channel, where the inlet portion is configured to move ink from the main ink inlet to the first openings. Each first opening is configured to direct ink toward an ink inlet channel for each of a plurality of printhead modules. A plurality of second openings are formed in the outlet portion of the channel, where the outlet portion is configured to move ink away from the second openings toward the main ink outlet. Each second opening is configured to receive ink from an ink outlet channel for each of a plurality of printhead modules.

Embodiments of the recirculation assembly can include one or more of the following. The assembly can further include an upper layer and a lower layer, where the inlet and outlet portions of the channel are formed in the lower layer. An ink inlet conduit is formed in the lower layer providing a path from the main ink inlet to the inlet portion. An ink outlet conduit is formed in the upper layer providing a path from the main ink outlet to the outlet portion. The upper layer and the lower layer can be formed from a crystal polymer, and the upper layer adhered to the lower layer by a B stage epoxy. The constrictor can be a screw positioned in a substantially perpendicular orientation to a flow of ink through the channel, and can be movable to adjust the pressure differential between the inlet and outlet portions of the channel.

In general, in another aspect, the invention features an ink recirculation assembly including a main ink inlet configured to receive ink from an ink source, a main ink outlet configured to direct ink toward an ink source, and a channel extending between the main ink inlet and the main ink outlet. The channel includes a plurality of inlet portions and a plurality of outlet portions, where each of the inlet portions is separated from one of the outlet portions by a constrictor to form a pressure differential between each said inlet portion and outlet portion. A plurality of first openings are formed in each inlet portion of the channel, where each inlet portion is configured to move ink from the main ink inlet to the first openings. Each first opening is configured to direct ink toward an ink inlet channel for each of a plurality of printhead modules. A plurality of second openings are formed in each outlet portion of the channel, where each outlet portion is configured to move ink away from the second openings toward the main ink outlet. Each second opening is configured to receive ink from an ink outlet channel for each of a plurality of printhead modules.

Embodiments of the recirculation can include one or more of the following. The assembly can further include an upper layer and a lower layer, where the inlet and outlet portions of the channel are formed in the lower layer. An ink inlet conduit is formed in the lower layer providing a path from the main ink inlet to the inlet portion, and an ink outlet conduit is formed in the upper layer providing a path from the main ink outlet to the outlet portion. The upper layer and the lower layer can be formed from a crystal polymer and the upper layer adhered to the lower layer by a B stage epoxy. Each constrictor can be a screw positioned in a substantially perpendicular orientation to a flow of ink through the channel and can be movable to adjust the pressure differential between corresponding inlet and outlet portions of the channel.

In general, in another aspect, the invention features a system for recirculating ink. The system includes a plurality of printhead modules and a recirculation assembly. Each printhead module includes an ink inlet channel and an ink outlet channel. The recirculation assembly includes a main ink inlet configured to receive ink from an ink source, a main ink outlet configured to direct ink toward an ink source and a channel extending from the main ink inlet to the main ink outlet. The channel includes an inlet portion and an outlet portion separated by a constrictor to form a pressure differential between the inlet and outlet portions. A plurality of first openings are formed in the inlet portion of the channel, where the inlet portion is configured to move ink from the main ink inlet to the first openings. Each first opening is configured to direct ink toward an ink inlet channel for one of the plurality of printhead modules. A plurality of second openings are formed in the outlet portion of the channel, where the outlet portion is configured to move ink away from the second openings toward the main ink outlet. Each second opening is configured to receive ink from an ink outlet channel for one of the plurality of printhead modules.

The invention can be implemented to realize one or more of the following advantages. The recirculation assembly uses a single inlet/outlet path to carry ink to and away from more than one printhead module, thereby permitting a more compact design than if separate paths were required for each printhead module. A pressure differential between the inlet and outlet flow can be adjusted, and used to provide a pressure differential across a printhead module, such that ink flows into and out of the printhead module. The inlet/outlet paths can efficiently move ink through the recirculation assembly, thereby minimizing the time ink is away from an ink source, which can be significant if an ink source is used to maintain the ink a certain temperature above ambient temperature. The inlet/outlet paths facilitate filling the printhead modules with ink, removing air, flushing the printhead modules, and cleaning and purging of feed lines and the recirculation assembly itself.

Details of one or more implementations are set forth in the accompanying drawings and the description below. Other features and advantages may be apparent from the description and drawings, and from the claims.

DRAWING DESCRIPTIONS

These and other aspects will now be described in detail with reference to the following drawings.

FIGS. 6A-D show a filter assembly and a printhead housing.

Figure 7A:
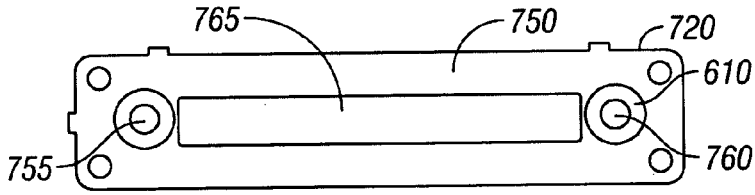

FIG. 7A is a plan view of an upper surface of a printhead housing.

Figure 7B:
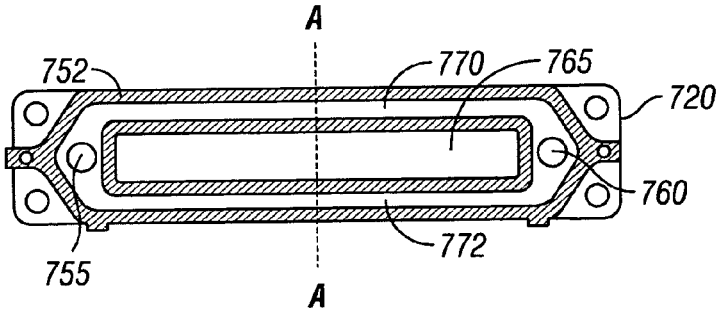

FIG. 7B is a plan view of a lower surface of the printhead housing of FIG. 7A.

Figure 7C:
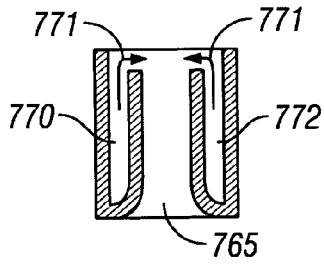

FIG. 7C is a cross-sectional view along line A-A of the printhead housing of FIG. 7B.

Figure 8A:
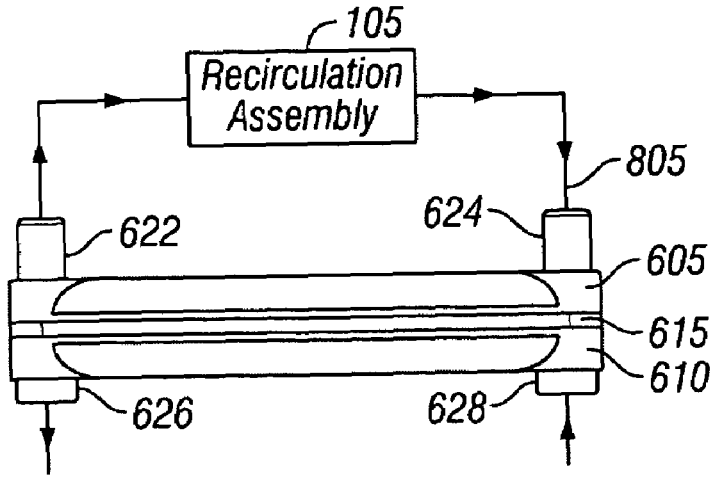

FIG. 8A is a side view of a filter assembly showing a recirculation ink flow path.

Figure 8B:
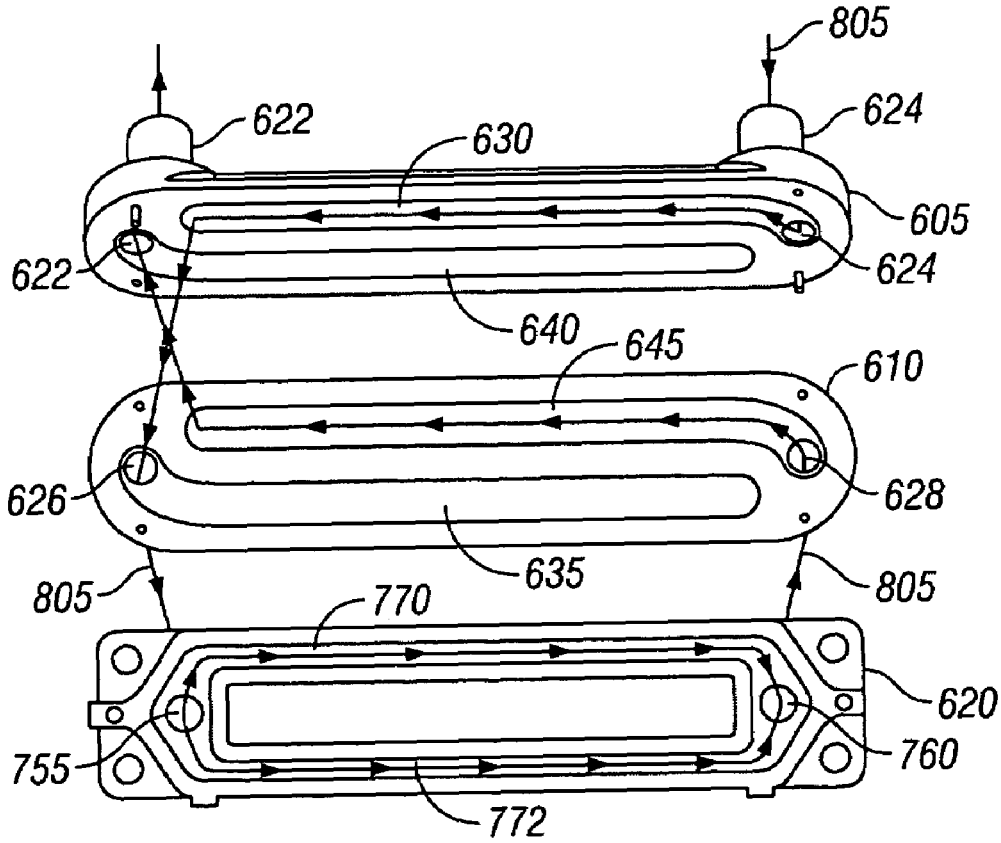

FIG. 8B is an exploded view of a filter assembly and a printhead housing showing a recirculation ink flow path.

Like reference symbols in the various drawings indicate like elements.

DETAILED DESCRIPTION

An ink recirculation assembly includes a main ink inlet configured to receive ink from an ink source and a main ink outlet configured to direct ink toward an ink source. A channel extends from the main ink inlet to the main ink outlet. The channel includes an inlet portion and an outlet portion separated by a constrictor to form a pressure differential between the inlet and outlet portions. The inlet portion of the channel is configured to deliver ink to one or more printhead modules, and the outlet portion is configured to receive ink from one or more printhead modules. In one embodiment, the channel can be formed from a flexible tubing and the constrictor can be a valve in the tubing, a clamp on the tubing or a screw through the tubing.

Figure 1:
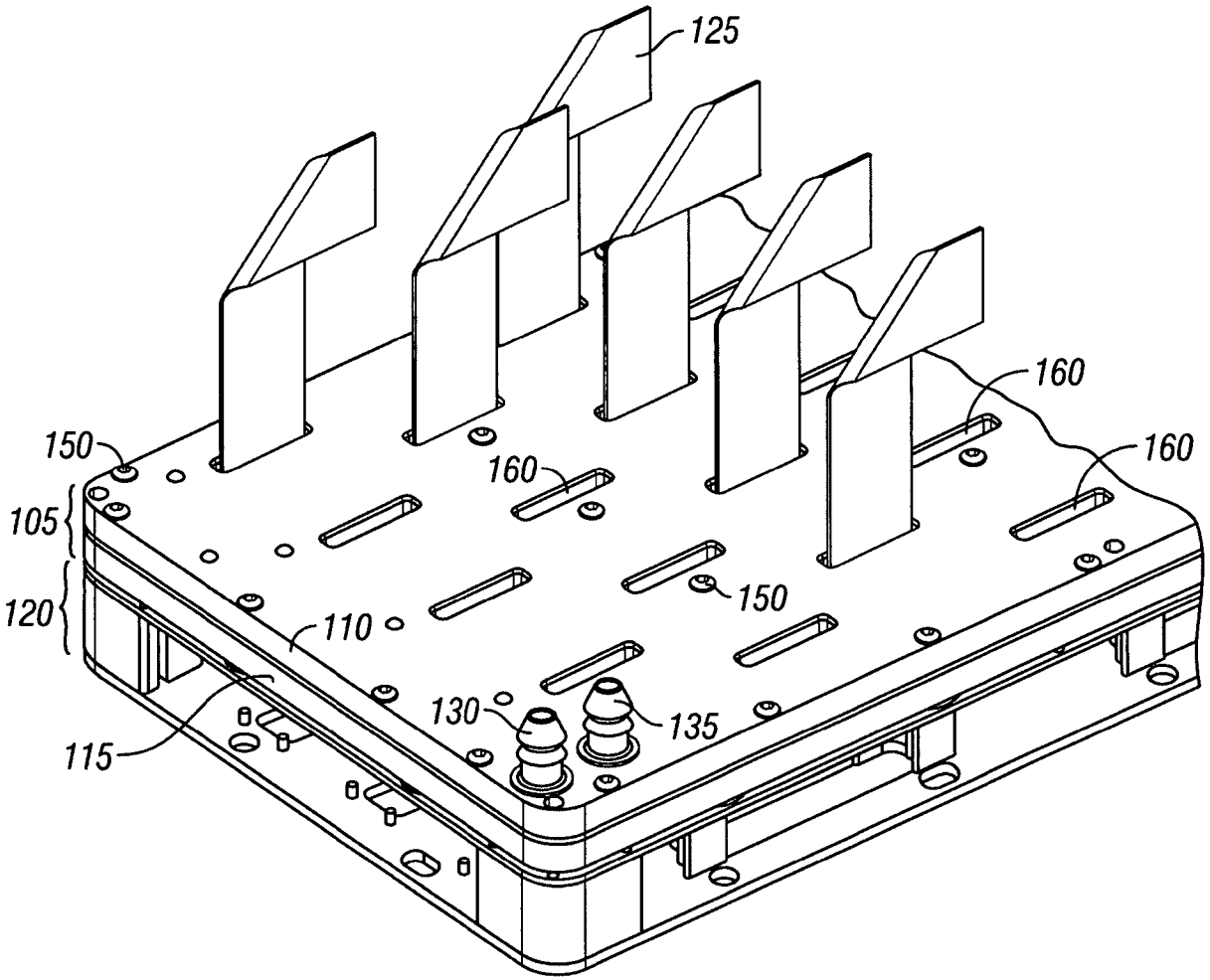
FIG. 1 shows a recirculation assembly affixed to a mounting assembly.

FIG. 1 shows another embodiment of the recirculation assembly 105. The recirculation assembly includes an upper layer 110 and a lower layer 115, and the channel is formed within the layers 110, 115. The recirculation assembly 105 is shown affixed to a mounting assembly 120 housing a plurality of printhead modules. A printhead module can include a printhead unit, such as the semiconductor printhead unit described in U.S. Provisional Application Ser. No. 60/510,459, entitled "Print Head with Thin Membrane", filed Oct. 10, 2003, the disclosure of which is hereby incorporated by reference. The printhead unit includes ink nozzles for ejecting ink drops onto a printing media moving relative to the printhead unit. Flexible circuits 125 extend from the plurality of printhead modules (only some of the flexible circuits are shown) out through apertures 160 in the upper layer 110 of the recirculation assembly 105. The circuits 125 can connect a processor housed in a printer to piezoelectric actuators within the printhead modules, to control ejection of ink drops from the printhead modules.

Ink can enter the recirculation assembly 105 through a main ink inlet 130 and exit through a main ink outlet 135. Ink flows from the main ink inlet 130 through the recirculation assembly 105, where some of the ink is passed to the plurality of printhead modules; the remainder of the ink moves through the recirculation assembly 105 and exits through the main ink outlet 135. The ink that is passed to the plurality of printhead modules may either be consumed during a printing operation, or may recirculate through the printhead modules and pass back to the recirculation assembly 105 and exit through the main ink outlet 135. The ink flow within the recirculation assembly 105 will be described in further detail below.

The ink flow originates at an ink source, such as a bottle, bag or custom ink supply reservoir. In some applications, the ink source is heated to maintain the ink at a certain temperature above the ambient temperature, for example, to maintain a desired viscosity of the ink. Once the ink flows through the recirculation assembly 105 and printhead modules, the ink can be returned to the same ink source, such that the temperature can be maintained. Alternatively, the ink can be returned to a different location, which may or may not be in fluid communication with the ink source. For example, the ink may be returned to a different location for changing out the color of ink, cleaning the recirculation assembly, purging of aged or degraded ink, or replacement of the ink with a cleaning or storage fluid.

Figure 2A:
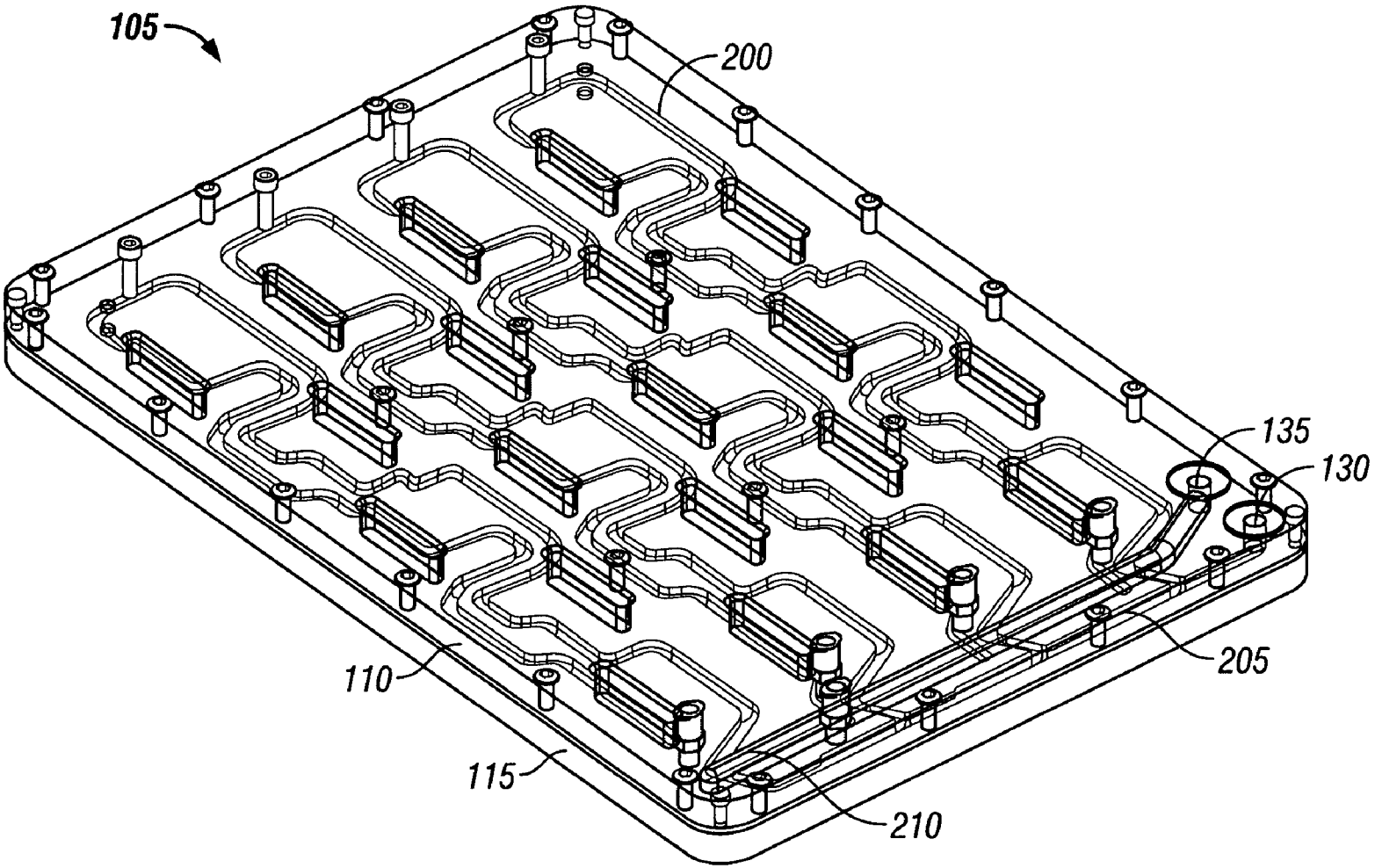
FIG. 2A shows a recirculation assembly.

FIG. 2A shows the upper layer 110 of the recirculation assembly 105 affixed to the lower layer 115; the upper layer 110 is drawn as transparent, such that a channel 200 formed in the lower layer 115 is visible. An ink inlet conduit 205 extending from the main ink inlet 130 along one side of the lower layer 115 carries ink from the main ink inlet 130 to four sets of inlet/outlet portions of the channel—each set of inlet/outlet portions corresponding to a set of printhead modules housed in the mounting assembly 120. The ink inlet conduit 205 is shown clearly in FIG. 3A, which depicts the inner surface 305 of the lower layer 115. An ink outlet conduit 210 (shown clearly in FIG. 2B) is formed in the upper layer 110 and connects to each outlet portion of the channel 200. The ink outlet conduit 210 terminates at the main ink outlet 135 formed in the upper layer 110.

By using a single inlet/outlet portion of the channel to recirculate ink to more than one printhead module, the cumulative length of the ink path can be minimized, thereby reducing the amount of time ink remains in the recirculation assembly 105, and therefore away from a heated ink source—which can be significant if the ink must be maintained at a certain temperature above the temperature in the recirculation assembly 105 in order to maintain a certain viscosity and/or to prevent coagulation of the ink.

Figure 4A:
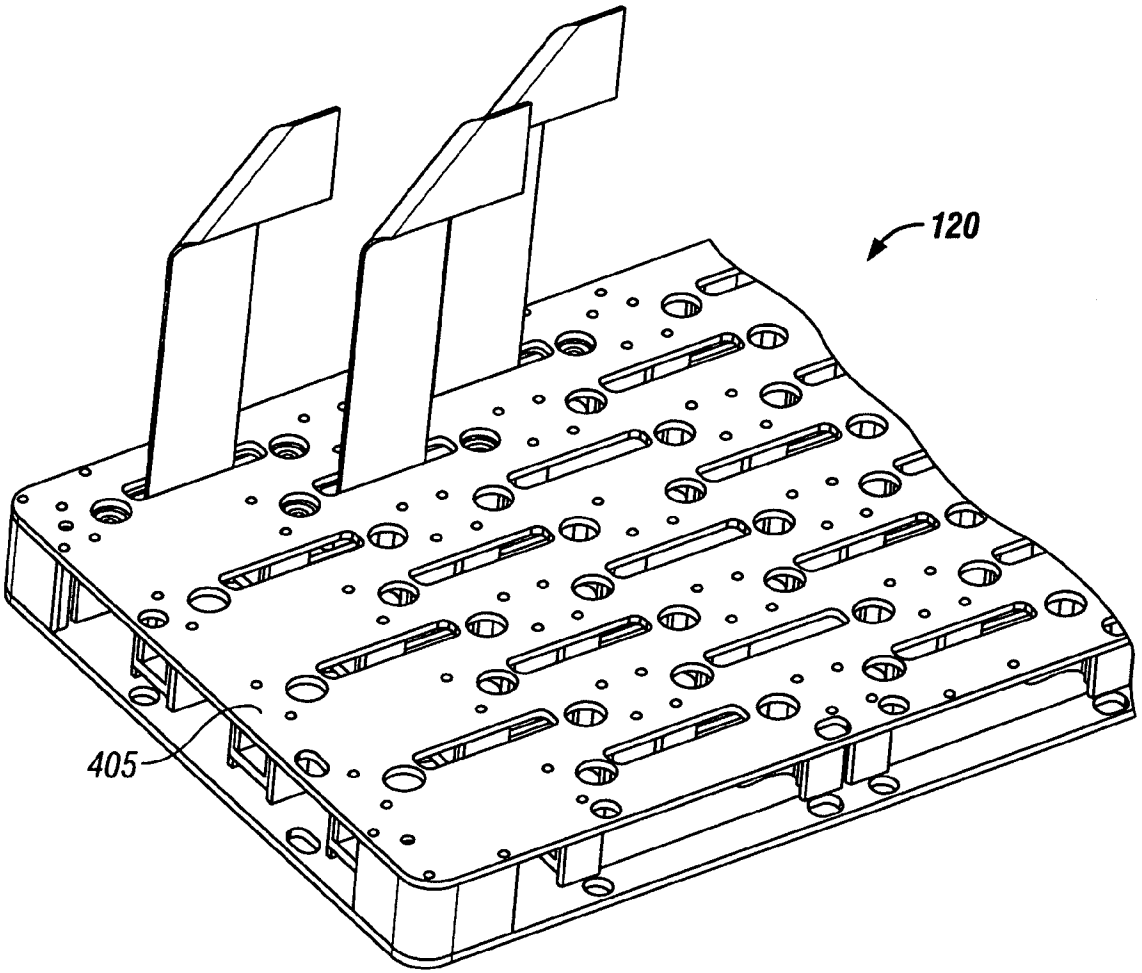
FIG. 4A shows a mounting assembly.
Figure 4B:
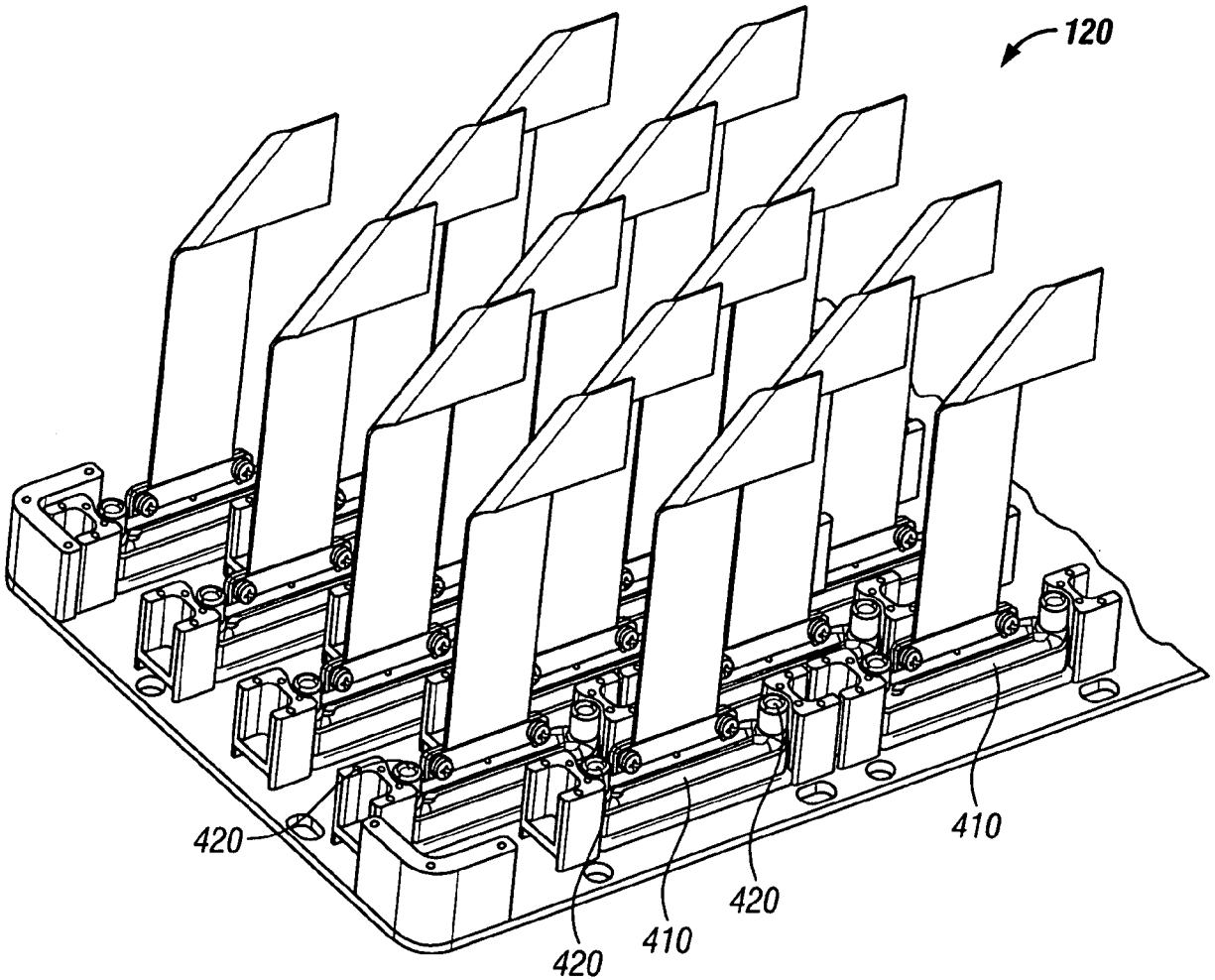
FIG. 4B shows a mounting assembly with an upper plate removed.

The embodiment of the recirculation assembly 105 shown in FIG. 2A is configured to mate with a mounting assembly housing five columns of printhead modules. A portion of a mounting assembly 120 is shown in FIG. 4A and FIG. 4B that is configured to house at least five columns of printhead modules 410; the recirculation assembly 105 can mate with such a mounting assembly 120. In one embodiment, the mounting assembly 120 can be a mounting assembly as described in U.S. Provisional Application Ser. No. 60/567,070, entitled "Mounting Assembly" of Kevin von Essen and John Higginson, filed on Apr. 30, 2004, the entire contents of which are hereby incorporated by reference. A printhead module typically includes an ink nozzle unit having multiple nozzles, each nozzle capable of ejecting an ink drop. For example, an ink nozzle unit may have 60 nozzles, and a column of five printhead modules arranged side-by-side one another can therefore print simultaneously from 300 nozzles. Each set of printhead modules 410 is configured such that the outermost nozzles of adjacent printhead modules 410 are spaced from one another such that when printing from adjacent printhead modules 410 simultaneously, the ejected ink drops are spaced at a consistent pitch. In one embodiment, four sets of printhead modules may be used (e.g., a set including 5 or more printhead modules as shown), for example, so that each row can print a different color (described further below).

Figure 3A:
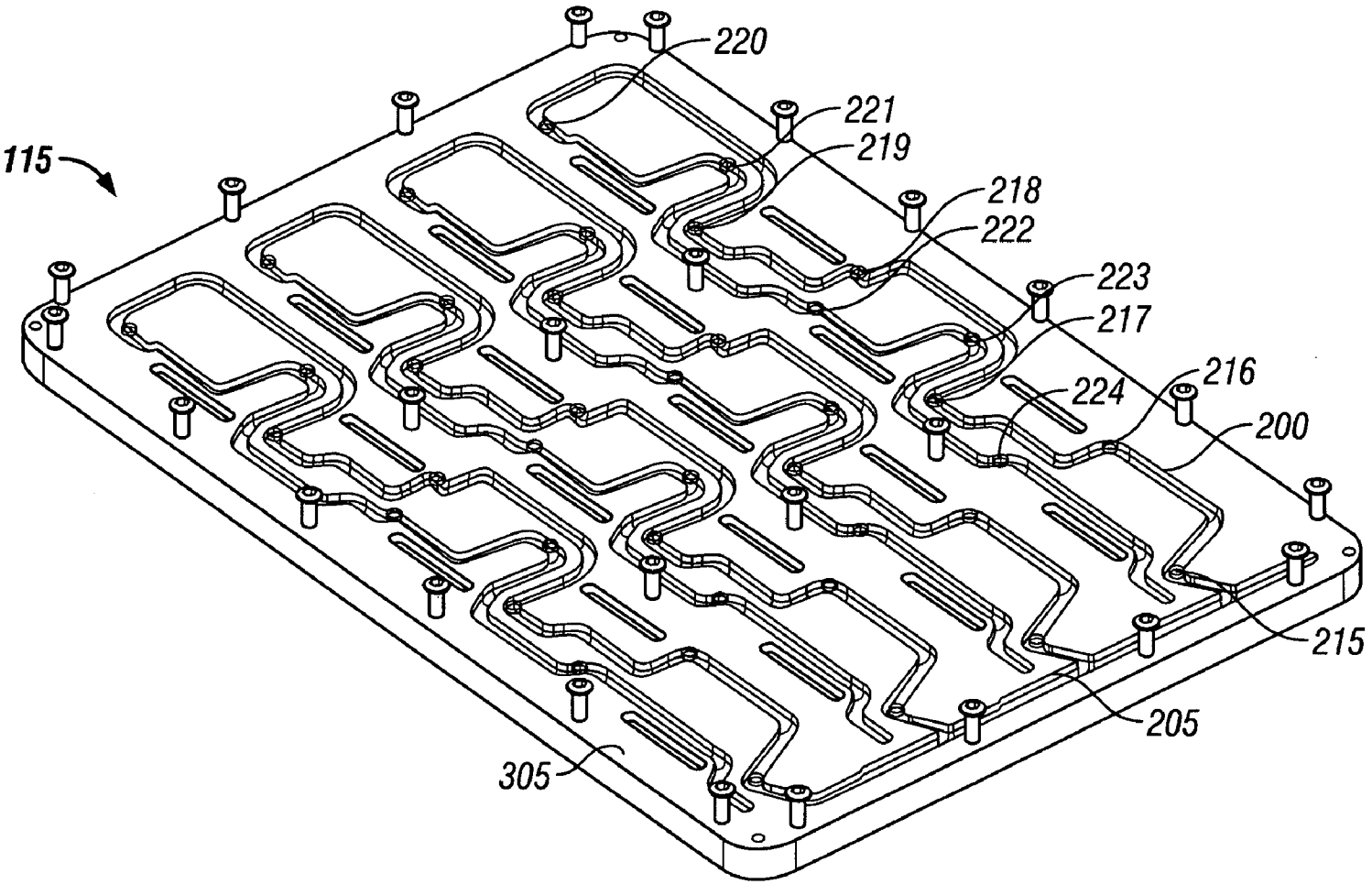
FIG. 3A shows an inner surface of a lower layer of a recirculation assembly.
Figure 3B:
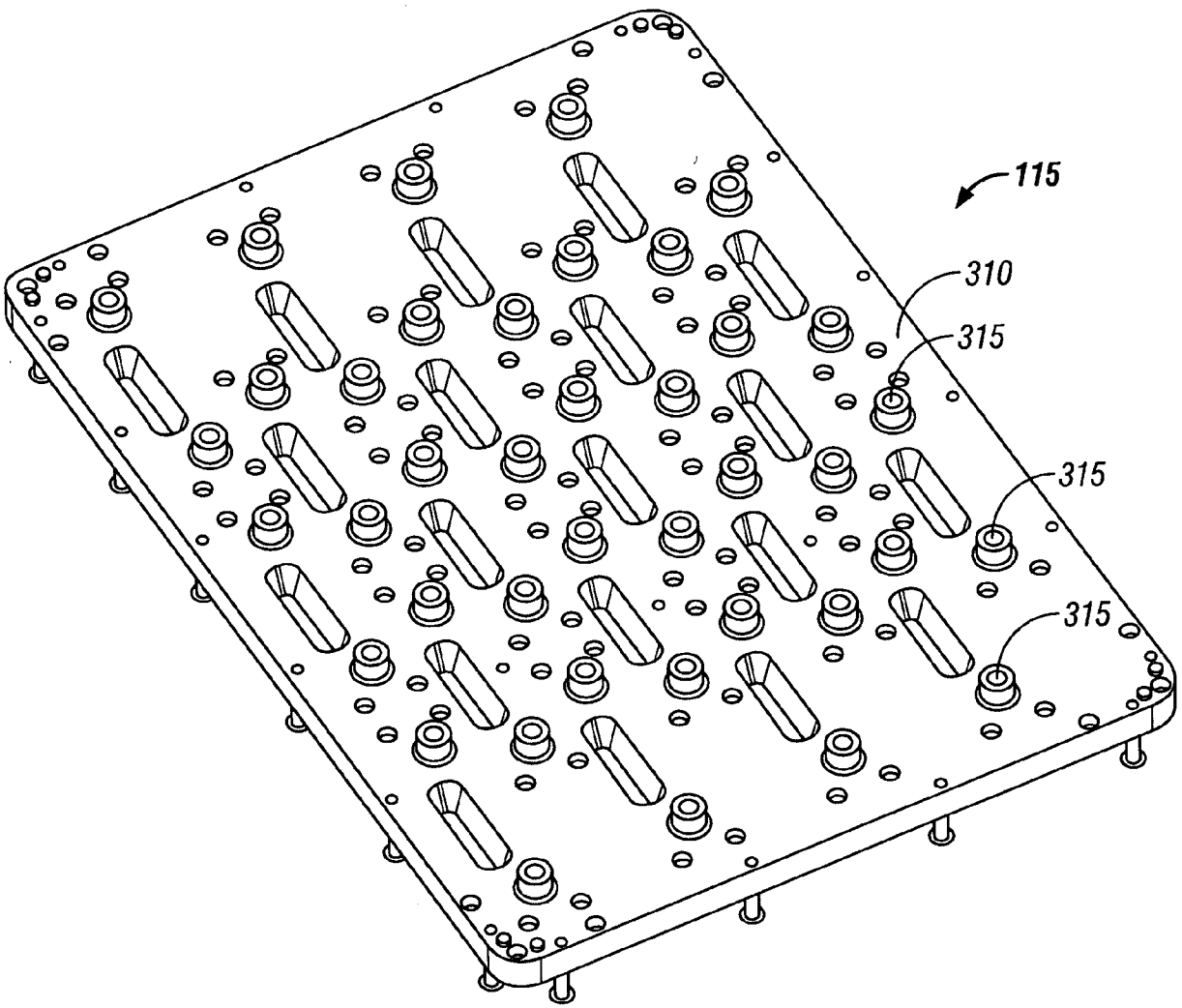
FIG. 3B shows an outer surface of a lower layer of a recirculation assembly.

Referring to FIGS. 3A, 3B and 4A, the outer surface 310 of the lower layer 115 is configured to mate with the upper plate 405 of the mounting assembly 120. Openings 215-224 are formed in the channel 200 and lead to ink channels 315 formed on the outer surface 310 of the lower layer 115. The ink channels 315 are configured to engage corresponding apertures 415 formed in the upper plate 405 of the mounting assembly 120 and mate with ink channels 420 formed in printhead modules housed by the mounting assembly 120, shown in FIG. 4B. In this manner, the ink flow through the channel 200 is in fluid communication with the printhead modules housed by the mounting assembly 120.

The recirculation assembly can be configured to mate with a mounting assembly housing a different number of, and/or differently arranged, printhead modules. The recirculation assembly 105 shown in FIGS. 2-3 is one embodiment and is described for illustrative purposes, and it should be understood that other embodiments are possible.

Figure 2B:
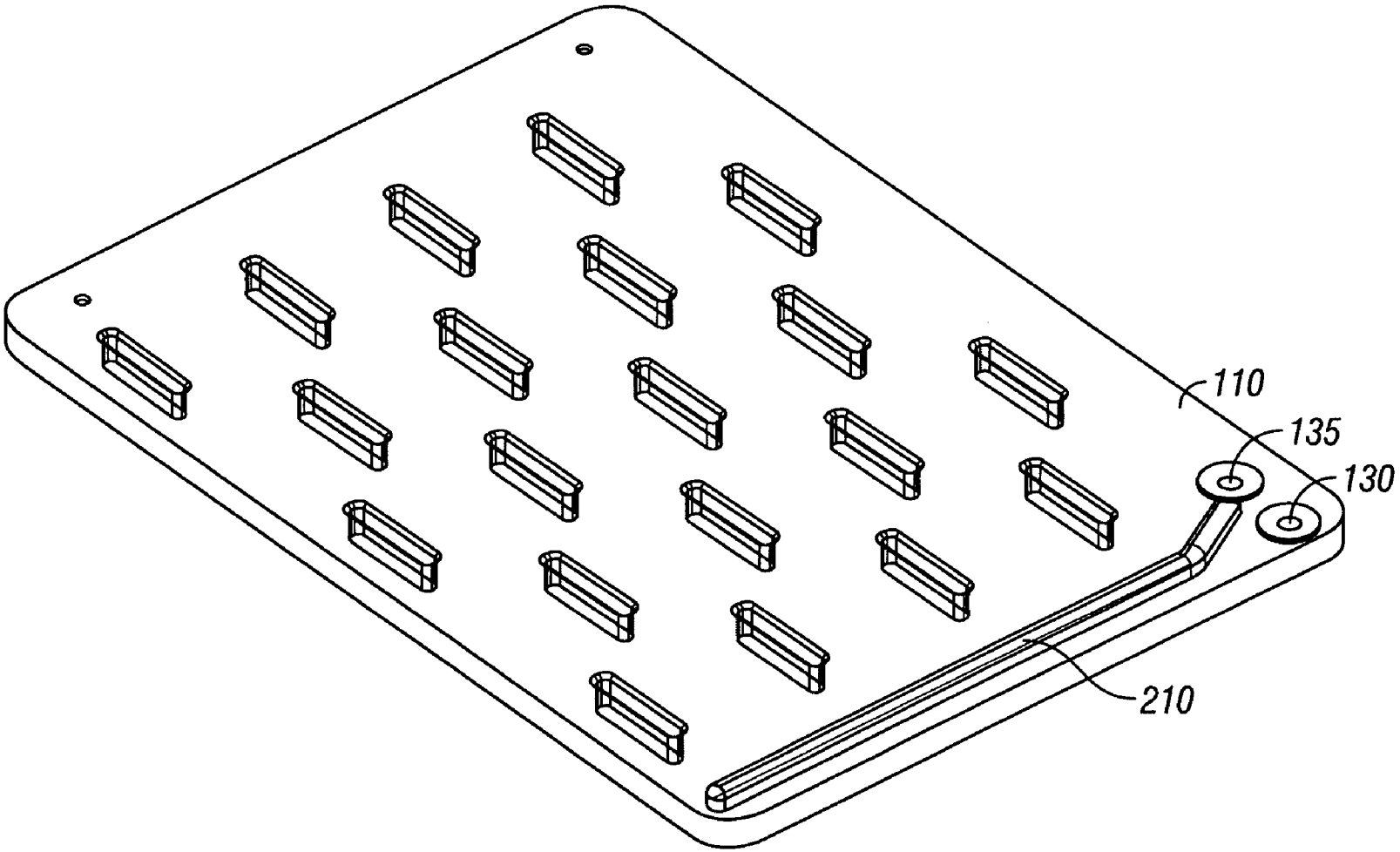
FIG. 2B shows an upper layer of the recirculation assembly of FIG. 2A.
Figure 5A:
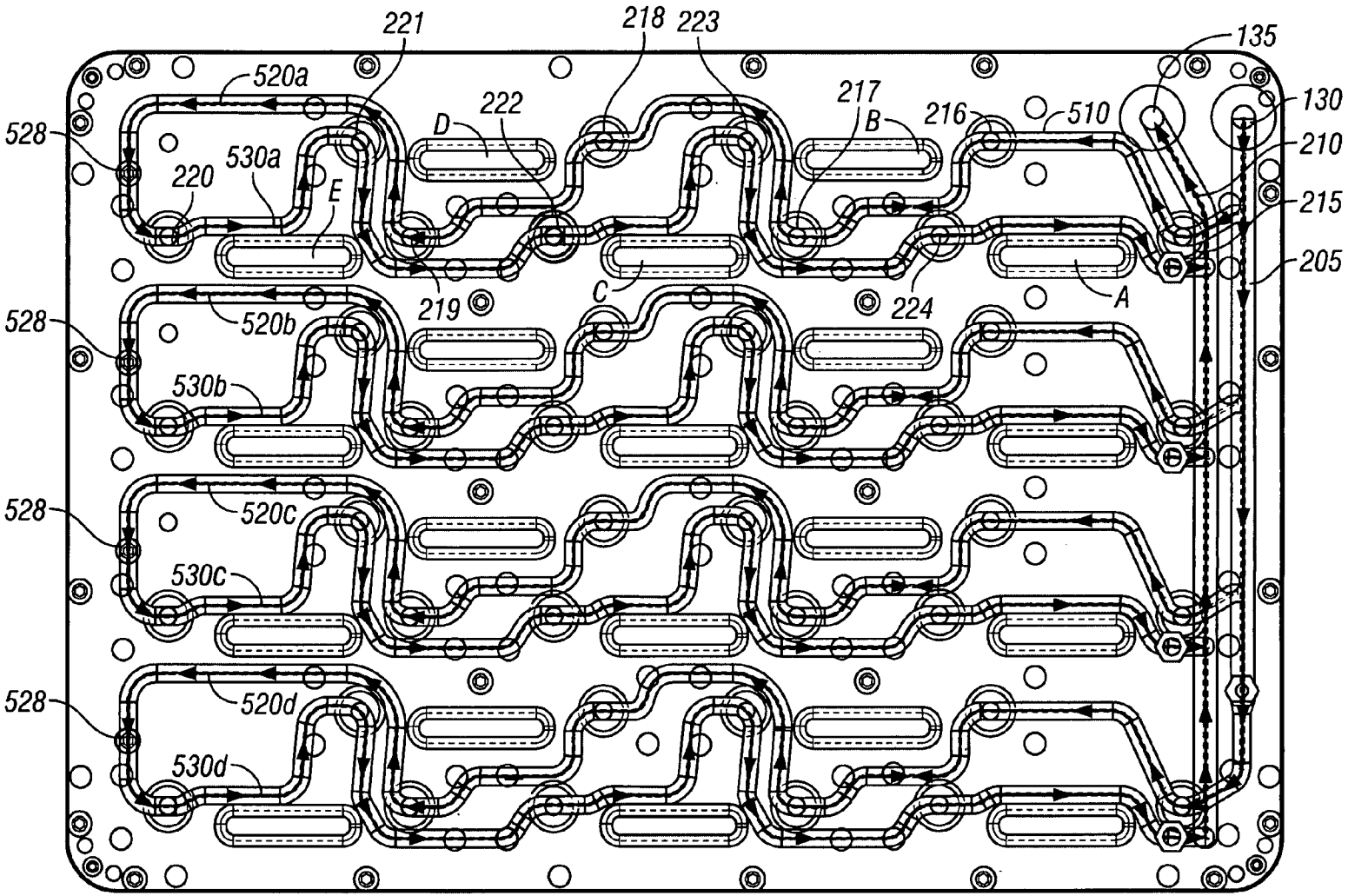
FIG. 5A shows an ink path through a recirculation assembly.

Referring again to FIGS. 2B and 3A, a channel 200 is formed in the lower layer 115 of the recirculation assembly 105, including the ink inlet conduit 205; and an ink outlet conduit 210 is formed in the upper layer 110. The channels formed in the lower layer 115 and upper layer 110 together form the flow path for ink circulating through the recirculation assembly 105. FIG. 5A shows a plan view of the channels formed in both layers 110, 115 of the recirculation assembly 105, with a path 510 marked indicating the flow path for the ink. The ink enters the recirculation assembly through a main ink inlet 130, which as shown in FIGS. 1, 2A and 2B initiates in the upper layer 110, passes through the upper layer 105 and terminates in the lower layer 115. The main ink inlet 130 can be connected to an ink source, for example, using tubing formed from an elastomeric material or a semi-rigid or rigid tubing. The ink flows from the ink source into the main ink inlet 130 and into the ink inlet conduit 205, from where the ink can flow into one of four inlet portions 520*a-d* of the channel 200, there being a separate inlet portion for each set of printhead modules (there may be additional inlet portions, however, for illustrative purposes we shall discuss the four inlet portions shown).

Figure 5B:
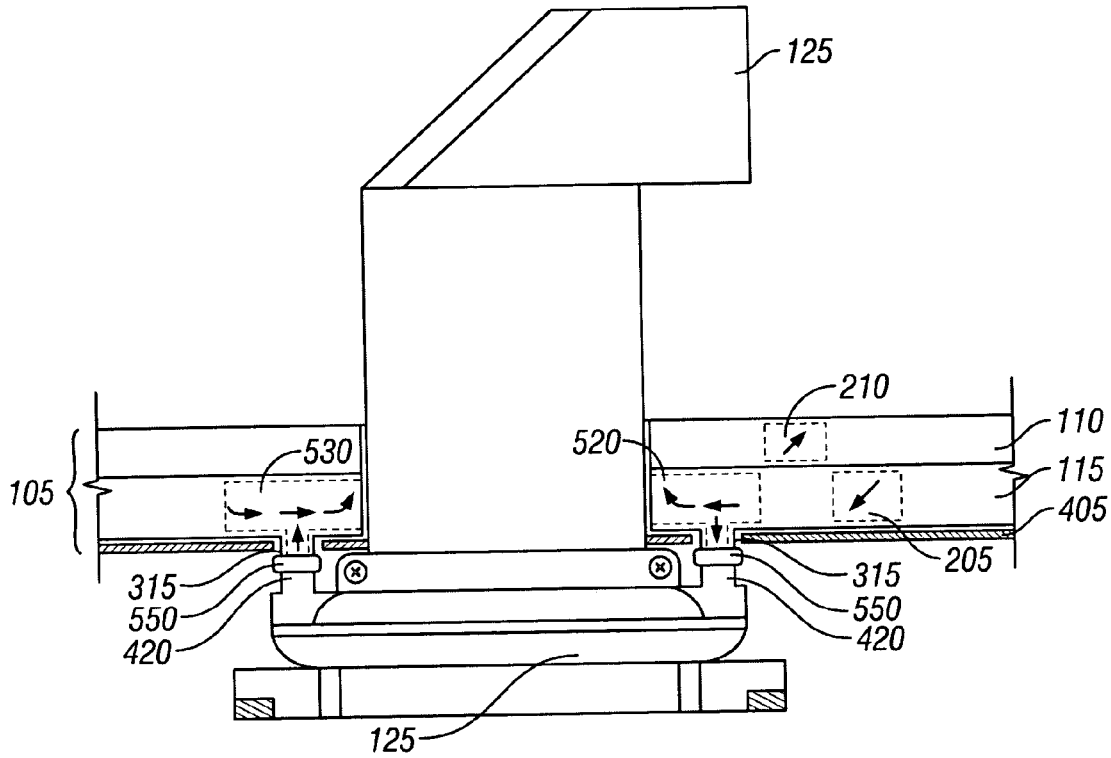
FIG. 5B shows a cross-sectional view of a portion of a recirculation assembly.

FIG. 5B shows a cross-sectional view of a portion of the recirculation assembly 105 and a printhead module 125. The figure is simplified for illustrative purposes and does not correspond to, nor show all the features of, the embodiment shown in FIGS. 1-5A. Cross-sectional views of the outlet path 210 formed in the upper layer 110 and the inlet path 205 formed in the lower layer 115 are shown. Ink channels 315 formed in the outer surface of the lower layer 115 are coupled to ink channels 420 formed in the printhead module 125. A compressible seal 550 is positioned between each ink channel 315 of the recirculation assembly 105 and corresponding ink channel 420 of the printhead module 125. Part of an inlet portion 520 of the channel 200 is shown, with some of the ink flow entering the ink channel 420 of the printhead module 125, and the balance of the ink flow continuing through the inlet portion 520 of the channel 200. Part of the outlet portion 530 of the channel 200 is shown, with ink entering the outlet portion 530 from the ink channel 420 of the printhead module 125 and combining with ink flowing through the outlet portion 530.

Referring again to FIG. 5A, the ink flow through an inlet portion of the channel 200 shall be described, and for illustrative purposes, inlet portion 520*a* is discussed. The inlet portion 520*a* of the channel includes five openings 215-219; each opening 215-219 is in fluid communication with an ink inlet channel 420 of one of the five printhead modules positioned beneath the inlet portion, when the recirculation assembly 105 is affixed to the mounting assembly 120. The inlet portion 520*a* includes openings 215, 216, 217, 218 and 219 that correspond to an ink inlet channel in a printhead module positioned directly below the openings A, B, C, D and E respectively. Some of the ink can thereby flow from the inlet portion 520*a* of the channel into a printhead module and into an ink nozzle unit, for ejection onto a printing substrate.

The ink that does not flow into one of the openings 215-219 continues to flow through the inlet portion 520*a* and reaches a constrictor 528. The constrictor 528 constricts the ink flow, thereby causing a pressure differential across the constrictor 528. The portion of the channel downstream of the constrictor 528 is referred to as the outlet portion 530*a*. The pressure in the outlet portion 530*a* is lower than the pressure in the inlet portion 520*a*. The constrictor 528 is adjustable to vary the pressure differential between the inlet and outlet portions

520*a*, 530*a*. Referring again to FIG. 2A, in one embodiment, the constrictor is a screw that can be screwed through the upper layer 110 and partially into the lower layer, so as to partially constrict flow through the channel 200.

The outlet portion 530*a* of the channel 200 also includes openings 220-224 in fluid communication with corresponding printhead modules. The ink flows from an ink outlet for a printhead module into the outlet portion 530*a*, such that the ink can eventually be recirculated back to the ink source. The outlet portion 530*a* includes openings 220, 221, 222, 223 and 224 corresponding to an ink outlet channel of printhead modules positioned directly beneath the openings E, D, C, B and A respectively. Ink flows from the printhead modules into the outlet portion 530*a* via the openings 220-224 (as discussed above in reference to FIG. 3B), and is directed toward the main ink outlet 135 of the recirculation assembly 105.

The pressure differential between the inlet and outlet portions 520*a*, 530*a* creates a pressure differential across each printhead module that is in fluid communication with the inlet and outlet portions 520*a*, 530*a*. Ink thereby flows into each printhead module from the inlet portion 520*a*, circulates through the printhead module—some of the ink being consumed by printing operations—and exits the printhead module into the outlet portion 530*a*; the pressure in the inlet portion 520*a* being higher than the pressure in the outlet portion 530*a*.

The recirculation assembly 105 can be operable without recirculating the ink. For example, the main ink inlet 130 and main ink outlet 135 can both be used to supply ink into the recirculation assembly 105, and the constrictors 528 can be opened to allow the ink to flow within the recirculation assembly 105. In one implementation, ink can be supplied through both the main ink inlet 130 and main ink outlet 135 during printing, and then switched (e.g., through valving) to a recirculation mode (as described above) to allow recirculation during idle times and/or for filling, flushing and cleaning the recirculation assembly 105.

In an embodiment, where each set of printhead modules is used to print a different color of ink, the recirculation assembly 105 is configured to provide separate inlet/outlet paths for each color of ink. For example, a separate ink inlet and ink outlet can be provided for each inlet/outlet portion, rather than the single main ink inlet 130 and main ink outlet 135 described above. Each inlet/outlet portion can be in fluid communication with the corresponding ink inlet and ink outlet via corresponding separate ink inlet and ink outlet conduits.

The upper and lower layers 110, 115 of the recirculation assembly 105 can be formed from any convenient material. In one embodiment, a crystal polymer, such as Ticona A130 LCP (Liquid Crystal Polymer) is used and the channels are formed in the upper and lower layers 110, 115 by injection molding, although other techniques, e.g., machining, vacuum or pressure forming, casting and the like can be used to form the channels. The upper and lower layers 110, 115 are connected to each other with a liquid tight connection, to ensure ink passing between the layers does not escape. For example, a B-stage epoxy can be used to join the layers together and to provide a seal, preventing leakage of ink. Alternatively, or in addition to an adhesive, such as the B-stage epoxy, multiple screws 150 can be used to join the upper and lower layers 110, 115, as shown in FIG. 1. Other techniques to the join the layers can include ultrasonic or solvent welding, elastomeric seals or gaskets, dispensed adhesive, or a metal-to-metal fusion bond.

The lower layer 115 can be affixed to the mounting assembly 120 using any convenient means, such as screws, an adhesive or both. As shown in FIG. 5B, a compressible seal 550 can be positioned between each ink channel 315 formed on the outer surface 310 of the lower layer 115 and the corresponding ink channel 420 formed on the printhead module, such that ink cannot escape while moving between the recirculation assembly 105 and the printhead modules.

In one implementation, the lower layer 115 and upper layer 110 are formed by molding, and the constrictor 528 (or constrictors) is molded as a part of either or both of the lower and upper layers 115, 110. In this implementation, the constrictor 528 is not adjustable.

A printhead module housed within the mounting assembly 120 can have any configuration, so long as the printhead module includes at least one ink inlet channel and one ink outlet channel, such that ink can be recirculated through the recirculation assembly 105 and through each printhead module, as described above in reference to FIGS. 5A and 5B. In one embodiment, a printhead module can be configured as described in U.S. patent application Ser. No. 10/836,456, entitled "Elongated Filter Assembly" of Kevin von Essen, filed on Apr. 30, 2004, the entire contents of which are hereby incorporated by reference. Such a printhead module 410 is shown in FIG. 4B, and more closely in FIGS. 6A to 6D.

Figure 6A:
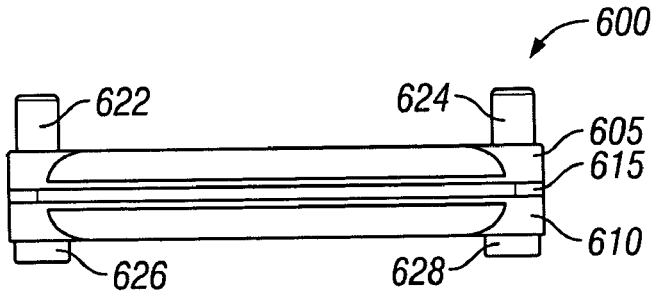
Figure 6B:
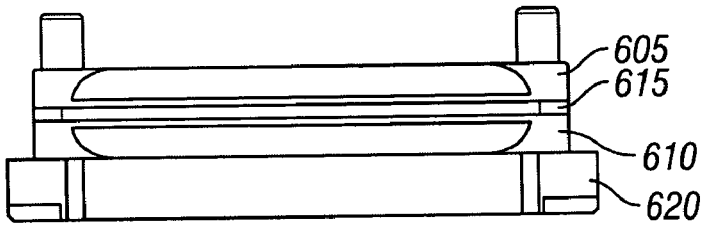
Figure 6C:
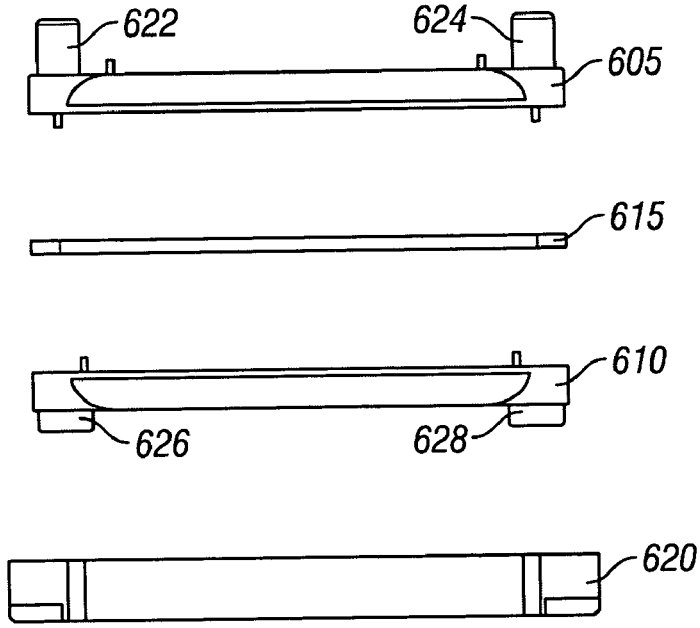

FIGS. 6A-C show a printhead module including a filter assembly 600 and a printhead housing 620. The filter assembly 600 includes an upper portion 605, lower portion 610 and a thin membrane 615 positioned between the upper portion 605 and the lower portion 610. The filter assembly 600 is mounted on a printhead housing 620, that is configured to house a printhead body for ejecting ink drops from an ink nozzle unit, such as the semiconductor printhead body described in U.S. Provisional Application Ser. No. 60/510,459, entitled "Print Head with Thin Membrane", filed Oct. 10, 2003.

Each of the upper and lower portions 605, 610 include at least one ink channel. In the embodiment shown in FIG. 6A, there are two ink channels 622, 624 in the upper portion 605, and two ink channels 626, 628 in the lower portion 610. An ink channel can function as either an inlet channel or an outlet channel, depending on the direction of ink flow, and whether the ink is recirculating through the printhead module 600. If the ink is recirculating, then one ink channel in upper portion 605 operates as an inlet and the other as an outlet, and similarly, one ink channel in the lower portion 610 operates as an inlet and the other as an outlet.

Figure 6D:
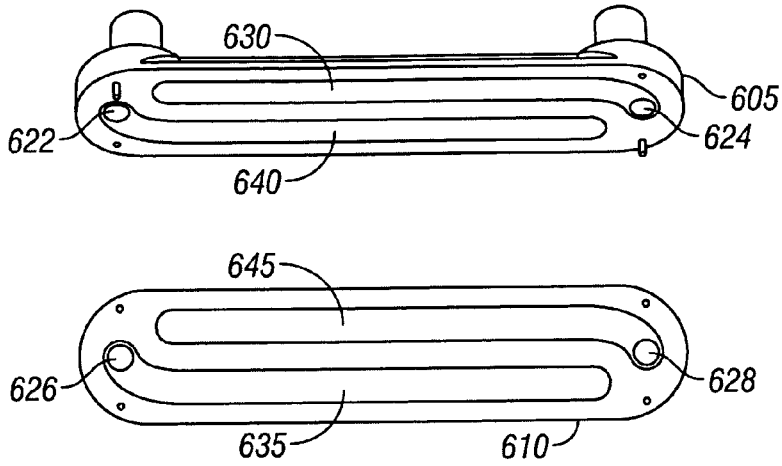

FIG. 6D shows a plan view of the lower portion 610 and a tilted side view of the upper portion 605, to illustrate the relationship of the upper and lower portions 605, 610. When the upper and lower portions 605, 610 are assembled as shown in FIG. 6A, an interior elongated chamber is formed between the portions 605, 610 for each pair of ink channels (a pair being an ink channel in the upper portion and a corresponding ink channel in the lower portion). That is, in the embodiment shown there are two pairs of ink channels, and accordingly there are two interior elongated chambers formed between the upper and lower portions 605, 610 when assembled.

An upper section of a first elongated chamber 630 is formed in the upper portion 605 of the filter assembly 600, which corresponds with a lower section of the first elongated chamber 635 formed in the lower portion 610 of the filter assembly 600. The first elongated chamber 630-635 forms a first ink path for ink flowing between the ink channel 624 formed in the upper portion 605 and the corresponding ink channel 626 formed on the opposite end of the lower portion 610.

Similarly, an upper section of a second elongated chamber 640 is formed in the upper portion 605, which corresponds with a lower section of the second elongated chamber 645 formed in the lower portion 610. The second elongated chamber 640-645 forms a second ink path for ink flowing between the ink channel 622 formed in the upper portion 605 and the corresponding ink channel 628 formed on the opposite end of the lower portion 610.

A membrane providing a permeable separator between an upper section and a lower section of an elongated chamber formed within the filter assembly 600 can filter ink as ink flows from one end of the elongated chamber to the other. For example, a membrane 615 can be positioned between the upper and lower portions 605, 610 of the filter assembly 600 as shown in FIG. 6A, thereby separating the upper section 630 of the first elongated chamber from the lower section 635, and separating the upper section 640 of the second elongated chamber from the lower section 645. Alternatively, a separate membrane can be used to separate each of the elongated chambers.

Referring to FIGS. 7A-7C, the printhead housing 620 is shown. FIG. 7A shows a plan view of a surface 750 of the printhead housing 620 that mates with the lower portion 610 of the filter assembly 600. An opening to an ink channel 755 aligns with the ink channel 626 formed in the lower portion 610 of the filter assembly 600, and a second opening to a second ink channel 760 aligns with the ink channel 628 formed in the lower portion 610. FIG. 7B shows a plan view of the opposite surface 752 of the printhead housing 620. An opening 765 is configured to house a printhead assembly, for example, a semiconductor printhead, that includes an ink nozzle unit for injecting ink drops. The ink channels 755 and 760 terminate in channels 770 and 772 formed on either side of the opening 765. A cross-sectional view of the printhead housing 720 taken along line A-A is shown in FIG. 7C, illustrating the channels 770 and 772 formed along the length of the printhead assembly. The ink flows along the paths 771 shown from the channels 770, 772 toward and into an ink nozzle assembly within a printhead (not shown) that can be mounted within the opening 765.

In the embodiment of the printhead module shown in FIGS. 6A-6D, which includes two pairs of ink channels, there are at least two ink flow patterns; in a first ink flow pattern both ink channels 622, 624 formed in the upper portion 605 operate as ink inlets and both ink channels 626, 628 formed in the lower portion 610 operate as ink outlets. In a second ink flow pattern, one ink channel 624 in the upper portion 605 and one ink channel 628 in the lower portion 610 operate as ink inlets, while the remaining ink channel 622 in the upper portion 605 and ink channel 626 in the lower portion 610 operate as ink outlets. The second ink flow pattern can be a recirculation scheme. In some applications, the ink must be kept moving, so as not to coagulate, and/or must be kept at a temperature significantly above the ambient temperature. In such applications, a recirculation scheme may be appropriate.

FIGS. 8A and 8B show the printhead module configured with one ink flow 805 entering the filter assembly 600 from the recirculation assembly 105 and exiting into the printhead housing 620, which is in fluid communication with an ink nozzle assembly. The ink flows through the printhead housing 620 where some of the ink is consumed by the ink nozzle assembly (i.e., used during an ink jet printing process). The remaining ink flows through the printhead housing 620 and back into the filter assembly 600 and finally exits the filter assembly 600 and returns to the recirculation assembly 105.

Referring to FIG. 8B, the ink flow 805 enters the filter assembly 600 from the recirculation assembly 605 through the ink channel 624 formed in the upper portion 605. The ink flows through the ink channel 624 into the upper section 630 of the first elongated chamber. As the ink flows from right to left along the length of the first elongated chamber, the ink can be filtered through a membrane (not shown) providing a permeable separator between the upper section 630 and the lower section 635 of the first elongated chamber. The ink flow 805 is shown as a path in the upper section 630 of the first elongated chamber, however, it should be understood that as the ink filters through the membrane, ink also flows along the lower section 635 of the first elongated chamber, even though a path is not shown.

Once the ink reaches the end of the first elongated chamber, the ink flows through the ink channel 626 and exits the lower portion 610 of the filter assembly 600. The ink flow 805 enters an ink channel 755 in the printhead housing 620, and flows from the ink channel 755 along the channels 770 and 772 formed in the lower surface of the printhead housing 620. Some of the ink flow 805 enters a printhead housed within the printhead housing 620 and is consumed by an ink nozzle assembly therein. The remaining ink flows from the channels 770, 772 toward and into the ink channel 760.

The ink flow 805 exits the printhead housing 620 and enters the lower portion 610 of the filter assembly 600 through the ink channel 628. The ink flows from the ink channel 628 into the lower section 645 of the second elongated chamber. As the ink flow 805 moves right to left along the length of the second elongated chamber, the ink can be filtered by a membrane (not shown) providing a permeable separator between the upper and lower sections 640, 645 of the second elongated chamber. Alternatively, there can be no membrane separating the upper and lower sections 640, 645 of the second elongated chamber as it may not be required or desirable to filter the ink flow 805 as the ink is leaving the filter assembly 600. The ink flow 805 exits the filter assembly 600 through the ink channel 622 formed in the upper portion 605 and returns to the recirculation assembly 105.

The use of terminology such as "upper" and "lower" throughout the specification and claims is for illustrative purposes only, to distinguish between various components of the recirculation assembly. The use of "upper" and "lower" does not imply a particular orientation of the assembly. For example, the upper layer can be orientated above, below or beside the lower layer, and visa versa, depending on whether the recirculation assembly is positioned horizontally face-up, horizontally face-down or vertically.

Although only a few embodiments have been described in detail above, other modifications are possible. Other embodiments may be within the scope of the following claims.

What is claimed is:

1. An ink recirculation assembly, comprising:

a main ink inlet configured to receive ink from an ink source;

a main ink outlet configured to direct ink toward an ink source; and a channel extending from the main ink inlet to the main ink outlet, the channel including an inlet portion and an outlet portion separated by a constrictor to form a pressure differential between the inlet and outlet portions, where the inlet portion of the channel is configured to deliver ink to one or more printhead modules and the outlet portion is configured to receive ink from one or more printhead modules, wherein the pressure differential between the inlet and outlet portions creates a pressure differential across the one or more printhead modules.

2. The ink recirculation assembly of claim 1, wherein the channel is formed from a flexible tubing.

3. The ink recirculation assembly of claim 1, further comprising an upper layer and a lower layer, and wherein:

the inlet and outlet portions of the channel are formed in the lower layer;

an ink inlet conduit is formed in the lower layer providing a path from the main ink inlet to the inlet portion; and an ink outlet conduit is formed in the upper layer providing a path from the main ink outlet to the outlet portion.

4. The ink recirculation assembly of claim 1, wherein the constrictor comprises a screw positioned in a substantially perpendicular orientation to a flow of ink through the channel and is movable to adjust the pressure differential between the inlet and outlet portions of the channel.

5. The ink recirculation assembly of claim 1, wherein the constrictor comprises a clamp and is adjustable to adjust the pressure differential between the inlet and outlet portions of the channel.

6. An ink recirculation assembly, comprising:

a main ink inlet configured to receive ink from an ink source;

a main ink outlet configured to direct ink toward an ink source;

a channel extending from the main ink inlet to the main ink outlet, the channel including an inlet portion and an outlet portion separated by a constrictor to form a pressure differential between the inlet and outlet portions;

a plurality of first openings formed in the inlet portion of the channel, where the inlet portion is configured to move ink from the main ink inlet to the first openings and each first opening is configured to direct ink toward an ink inlet channel for each of a plurality of printhead modules; and a plurality of second openings formed in the outlet portion of the channel, where the outlet portion is configured to move ink away from the second openings toward the main ink outlet and each second opening is configured to receive ink from an ink outlet channel for each of a plurality of printhead modules, wherein the pressure differential between the inlet and outlet portions creates a pressure differential across the plurality of printhead modules.

7. The ink recirculation assembly of claim 6, the assembly further comprising an upper layer and a lower layer, and wherein:

the inlet and outlet portions of the channel are formed in the lower layer;

an ink inlet conduit is formed in the lower layer providing a path from the main ink inlet to the inlet portion; and an ink outlet conduit is formed in the upper layer providing a path from the main ink outlet to the outlet portion.

8. The ink recirculation assembly of claim 7, wherein the upper layer and the lower layer are formed from a crystal polymer and the upper layer is adhered to the lower layer by a B stage epoxy.

9. The ink recirculation assembly of claim 6, wherein the constrictor comprises a screw positioned in a substantially perpendicular orientation to a flow of ink through the channel and is movable to adjust the pressure differential between the inlet and outlet portions of the channel.

10. An ink recirculation assembly, comprising:

a main ink inlet configured to receive ink from an ink source;

a main ink outlet configured to direct ink toward an ink source;

a channel extending between the main ink inlet and the main ink outlet, the channel including a plurality of inlet portions and including a plurality of outlet portions, where each of the plurality of inlet portions is separated from one of the plurality of outlet portions by a constrictor to form a pressure differential between each said inlet portion and outlet portion;

a plurality of first openings formed, in each inlet portion of the channel, where each inlet portion is configured to move ink from the main ink inlet to the first openings and each first opening is configured to direct ink toward an ink inlet channel for each of a plurality of printhead modules; and a plurality of second openings formed in each outlet portion of the channel, where each outlet portion is configured to move ink away from the second openings toward the main ink outlet and each second opening is configured to receive ink from an ink outlet channel for each of a plurality of printhead modules, wherein the pressure differential between the inlet and outlet portions creates a pressure differential across the plurality of printhead modules.

11. The ink recirculation assembly of claim 10, the assembly further comprising an upper layer and a lower layer, and wherein:

the inlet and outlet portions of the channel are formed in the lower layer;

an ink inlet conduit is formed in the lower layer providing a path from the main ink inlet to the inlet portion; and an ink outlet conduit is formed in the upper layer providing a path from the main ink outlet to the outlet portion.

12. The ink recirculation assembly of claim 11, wherein the upper layer and the lower layer are formed from a crystal polymer and the upper layer is adhered to the lower layer by a B stage epoxy.

13. The ink recirculation assembly of claim 10, wherein each constrictor comprises a screw positioned in a substantially perpendicular orientation to a flow of ink through the channel and is movable to adjust the pressure differential between corresponding inlet and outlet portions of the channel.

14. A system for recirculating ink, comprising:

a plurality of printhead modules, each printhead module including an ink inlet channel and an ink outlet channel; and a recirculation assembly including:

a main ink inlet configured to receive ink from an ink source;

a main ink outlet configured to direct ink toward an ink source;

a channel extending from the main ink inlet to the main ink outlet, the channel including an inlet portion and an outlet portion separated by a constrictor to form a pressure differential between the inlet and outlet portions;

a plurality of first openings formed in the inlet portion of the channel, where the inlet portion is configured to move ink from the main ink inlet to the first openings and each first opening is configured to direct ink toward an ink inlet channel for one of the plurality of printhead modules; and a plurality of second openings formed in the outlet portion of the channel, where the outlet portion is configured to move ink away from the second openings toward the main ink outlet and each second opening is configured to receive ink from an ink outlet channel for one of the plurality of printhead modules, wherein the pressure differential between the inlet and outlet portions creates a pressure differential across the plurality of printhead modules.

* * * * *